US005384983A

United States Patent [19]

Siggelin

[11] Patent Number: 5,384,983

[45] Date of Patent: Jan. 31, 1995

[54] METHOD AND GRINDING MACHINE FOR THE INTERNAL GRINDING OF BORES

[75] Inventor: Lars E. Siggelin, Rönninge, Sweden

[73] Assignee: AB UVA, Bromma, Sweden

[21] Appl. No.: 183,899

[22] Filed: Jan. 21, 1994

Related U.S. Application Data

[63] Continuation of Ser. No. 917,107, Aug. 7, 1992, abandoned.

[30] Foreign Application Priority Data

Feb. 16, 1990 [SE] Sweden ..... 90 00563-8

[51] Int. Cl.[6] ..... B24B 49/00; B24B 51/00; B24B 1/00

[52] U.S. Cl. ..... 451/65; 451/51

[58] Field of Search ..... 51/165.93, 165.91, 165.77, 51/281 R, 290, 326, 73 R, 74 R, 79, 95 R, 95 WH, 281 P

[56] References Cited

U.S. PATENT DOCUMENTS

| | | | |
|---|---|---|---|
| 4,110,938 | 9/1978 | Ito | 51/165.93 |
| 4,170,851 | 10/1979 | Enos | 51/165.93 |
| 4,274,898 | 6/1981 | Haltings, Jr. | 51/281 P |
| 4,718,196 | 1/1988 | Seewald | 51/165.93 |
| 4,956,945 | 9/1990 | Ooshima | 51/165.93 |
| 4,989,378 | 2/1991 | Junker | 51/165.93 |
| 4,993,196 | 2/1991 | Kobayashi | 51/281 P |
| 5,044,125 | 9/1991 | Lambert | 51/165.93 |
| 5,048,238 | 9/1991 | Ikeda | 51/73 R |
| 5,076,022 | 12/1991 | Ohta | 51/165.93 |
| 5,086,592 | 2/1992 | Schreiber | 51/73 R |

FOREIGN PATENT DOCUMENTS

| | | | |
|---|---|---|---|
| 2518503 | 5/1917 | Germany | 51/165.93 |

OTHER PUBLICATIONS

B. N. Baior and Y. L. Elisman, Automatic Internal Endface-Grinding Machine, pp. 18–21.

*Primary Examiner*—Bruce M. Kisliuk
*Assistant Examiner*—Bo Bounkong
*Attorney, Agent, or Firm*—Sughrue, Mion, Zinn, Macpeak and Seas

[57] ABSTRACT

In the process or internally grinding bores with the aid of a slightly conical grinding wheel (15) in a computer controlled manner, the rotational axis (14) of the grinding wheel is adjusted to a small angle ($\alpha$) in relation to the rotational axis (3*a*) of the workpiece (5). The grinding wheel is sharpened along a generatrix which lies opposite the generatrix of the wheel when the wheel is in rough grinding engagement with the bore. The rough grinding operation is carried out at a feed pressure such that twice this angle (i.e. $2(\alpha)$ is levelled-out or eliminated and the respective generatrices of the wheel and the bore will substantially coincide. The fine grinding phase of the grinding operation is carried out with substantially coinciding bore and grinding wheel generatrices along an opposite bore generatrix in relation to the rough grinding engagement location. The invention also relates to a grinding machine for carrying out the method.

10 Claims, 3 Drawing Sheets

METHOD AND GRINDING MACHINE FOR THE INTERNAL GRINDING OF BORES

This is a continuation of application Ser. No. 07/917,107 filed Aug. 7, 1992.

TECHNICAL FIELD

The present invention relates to a method and apparatus for the computer-controlled internal grinding of bores.

When using known computer techniques to effect internal grinding processes, it is possible to control highly complicated and optimized grinding processes with the aid of a programmable computer, when sensors are used to deliver signals relating to grinding forces, feed speeds, vibrations, grinding positions, prevailing bore diameters, etc. to the computer. The program required herefore, i.e. the software, is designed by the individual programmer. The grinding process can be controlled by various combinations of sensor signals. Time variations of such sensor signals can also be used to improve the straightness or trueness of the bores, for instance.

BACKGROUND ART

U.S. Pat. No. 3,274,738 teaches a method of controlling an internal grinding process which utilizes a principle known as the "controlled force method". U.S. Pat. No. 3,774,349 (Uhtenwoldt et al) describes an internal grinding machine equipped with a conical, outwardly tapering grinding wheel. GB,A,519.146 (Aero-Mecaniques) describes a bore and seating grinding process which is effected with the aid of a cylindrical grinding wheel having a conical end part.

U.S. Pat. No. 3,197,921 (Hohler et al), U.S. Pat. No. 3,534,509, U.S. Pat. No. 3,426,483 (Droitcour) and U.S. Pat. No. 3,694,969 (Hahn et al) describe other known methods, among them methods in which the aforesaid principle is combined with other principles.

THE BACKGROUND OF THE INVENTION

The present invention assumes the use of a programmable computer for controlling an internal grinding process. The invention is also based on the assumption that in each phase of a bore grinding process, there occurs optimal outward deflection or bending of the spindle or spindle extension carrying a grinding wheel in the feed direction and that there is an optimal angular deflection between the generatrice of the ground bore and the generatrice of the grinding wheel at the location of grinding engagement.

For instance, in many cases, it is desired that the angle between the generatrice of the bore and the cutting edge of the grinding wheel is as small as possible, i.e. an angular deflection of close to 0°, both in the rough grinding phase and the fine or finishing grinding phase. These grinding procedures will normally involve reciprocating relative axial movement between grinding wheel and workpiece, which results in deviations in the straightness of the bore being ground, due to angular twisting of the grinding wheel. This is particularly the case at the ends of the bore, where only a part of the full length of the grinding wheel is-located within the bore.

A relatively large constant outward deflection of the spindle carrying the grinding wheel is therewith assumed in the rough grinding phase. This results in a substantially constant grinding force, which is distributed substantially evenly over the cutting side or generatrice of the grinding wheel.

On the other hand, a relatively small linear deflection in the feed direction is assumed in the fine grinding phase, although a grinding force which is essentially evenly distributed over the cutting side or generatrice of the grinding wheel shall also be generated in this case.

It is known that the aforesaid desired optimum conditions can be achieved with a grinding spindle which is mounted on a slide system that can be rotated and moved linearly in the feed direction—and also linearly in a further direction—with the aid of a control system which includes a computer and the requisite sensors and transducers, as described above.

It is also known that when using such slide systems, each other combination of outward deflection or bending desired for each phase of the grinding process can be programmed in the computer.

A system of this kind, however, is essentially general and includes many parameters and degrees of freedom which influence the end result, and is therewith highly complicated.

OBJECT OF THE INVENTION

The present invention is also based on the aforesaid assumptions or conditions, and the object of the invention is to provide the possibility of effecting a grinding process with desired linear outward deflection or bending of the spindle axle and therewith with a grinding force of desired magnitude in the feed direction while maintaining, at the same time, a small angle, i.e. an angle of about 0°, between the generatrice of the grinding wheel at the location of grinding engagement and the generatrice of the bore, during both the rough grinding process and the fine grinding process, without the use of a slide system which can be pivoted continuously during the grinding process.

Another object is to provide a method of the aforesaid kind which does not require the use of excessively complicated computer programming and which will nevertheless provide a grinding result of good quality with a short cycle time for the grinding operation as a whole.

Another object of the invention is to provide a grinding method which can be applied readily to different types of existing grinding machines without requiring the provision of additional equipment, and also to provide a method which can be applied readily to satisfy different requirements on grinding accuracy and to make possible effective grinding engagement during the rough grinding phase and which will fulfil high accuracy demands placed on the fine grinding or finishing process.

Still a further object of the invention is to provide an internal grinding machine which will enable an optimum balance to be made between the rough grinding and fine grinding operations without requiring complicated additional equipment herefor, and which will also enable adjustments to be made between the rough grinding and fine grinding processes without requiring long tool feed paths. Another object is to provide a grinding machine with shorter cycle times and a machine which will fulfil the highest possible demands on the straightness and surface tolerances of the ground bore.

A BRIEF SUMMARY OF THE INVENTION

These and other objects are fulfilled by a method of the aforedescribed kind having the characteristic features set forth below.

This setting of the rotational axis of the grinding wheel at a small angle relative to the rotational axis of the workpiece, in combination with the feature of selecting the feed pressure during the rough grinding phase such that twice this angle is levelled-out or eliminated, means that the generatrice of the grinding wheel and the generatrice of the bore will essentially coincide at the grinding engagement location. Thus, substantially the whole of the axial length of the grinding wheel will be in active grinding engagement with the workpiece, which enables the rough grinding phase to be carried out with the greatest possible efficiency from a technical aspect and, because the generatrice of the grinding wheel is parallel with the generatrice of the desired bore along the whole of its length, the bore produced during the rough grinding process will be as straight or as true as possible.

When the grinding wheel is applied to the diametrically opposite side of the bore, in order to finely grind the bore surfaces, the generatrice of the grinding wheel will also coincide with the generatrice of the bore, therewith enabling the fine grinding phase to be effected with the greatest possible efficiency. It is not necessary to adjust the position of the spindle axis between these two grinding phases; the levelling-out of the setting angle of the spindle extension resulting from the feed pressure generated during the rough grinding phase will ensure that the generatrice of the grinding wheel at the location of grinding engagement will be substantially parallel with the axial extension of the bore, i.e. desired bore straightness or trueness is already ensured in the rough grinding phase.

Neither is it necessary to compensate for feed pressure when the grinding wheel engages the substantially diametrically opposite side of the bore in conjunction with a fine grinding operation. The generatrice of the grinding wheel at the location of grinding engagement will be parallel with the bore axis even when the feed pressure exerted during the fine grinding phase is very low, such low pressures being desired. It is also ensured in this case that engagement of the grinding wheel with the bore is effected essentially along the whole of the axial length of the grinding wheel.

It will be evident from the aforegoing that the fine grinding phase is effected with the same grinding wheel as that used in the rough grinding phase, which is preferred in practice as a rule. The advantages gained hereby are obvious. One important advantage is that the grinding wheel need only be moved along a very short path between the rough grinding and fine grinding phases. In practice, the distance of this path corresponds to the bore diameter minus the diameter of the grinding wheel at its centre point.

However, it lies within the scope of the present invention to carry out the fine grinding phase with a separate grinding wheel. In this case, the grinding wheel used in the fine grinding phase will preferably be made of a softer material than the rough grinding wheel, and the rough grinding and fine grinding wheels will be adjusted to mutually different angles in relation to the rotational axis of the workpiece.

Irrespective of whether one and the same grinding wheel or different grinding wheels is/are used for the rough grinding and fine grinding phases respectively, it lies within the purview of the invention to vary the angle of the rotational axis of the grind wheel during the grinding phase, in order to vary the feed pressure during respective rough grinding and/or fine grinding phase or phases.

This variation may be desirable, for instance, in order to increase the feed pressure and therewith render the rough grinding process more effective, for instance.

Subsequent to effecting such a change in the predetermined conditions, for instance so as to increase the amount of material removed over a short period of time, it is possible, in accordance with the invention, to return to current standard conditions in order to achieve the aforesaid elimination or levelling-out of the predetermined angular setting of the spindle axle extension, i.e. so that standard conditions prevail at the time of completing the rough grinding operation and also when commencing thereafter the fine grinding operation on the opposite side of the bore.

It has been stated in the aforegoing that the angle between the grinding wheel generatrice and the bore generatrice is preferably equal substantially to 0° at the location of grinding engagement. It is possible, however, within the scope of the present invention to vary this angle slightly, if so desired. This can be achieved, for instance, by pivoting or rotating the grinding spindle through a given (small) angle when sharpening the grinding wheel, and by then turning the grinding spindle back to its starting position when sharpening of the grinding wheel is completed.

As before mentioned, when different grinding wheels are used for rough grinding and fine grinding purposes, the grinding wheels can be set to mutually different angles in relation to the rotational axis of the workpiece. In this case, the fine grinding wheel will be set to a smaller angle than the rough grinding wheel.

The invention also relates to a grinding machine having the characteristic features set forth in below.

The aforegoing and the following text include such phrases as the "opposite sides" of the grinding wheel and the bore respectively, "the grinding wheel generatrice and the bore generatrice at the location of grinding engagement", etc. It should be borne in mind in this respect that both the grinding wheel and the workpiece, together with the bore formed therein, rotate during a grinding operation. Consequently, both the grinding wheel and the bore will constantly change position. The aforesaid phrases shall therefore be interpreted in this light, i.e. the expressions shall not always be taken literally but instead shall be interpreted as signifying a state in which the grinding wheel and the workpiece can be considered to be stationary at a given moment in time.

The invention will now be described in more detail with reference to exemplifying embodiments thereof illustrated in the accompanying schematic drawings. The inclined settings of the grinding spindle or spindles and outward deflection or bending of the grinding wheel has been greatly exagerated in all Figures, in order to illustrate the fundamental principles of the invention more clearly. In reality, these deflections and inclined settings are so small as to be unnoticeable to the naked eye.

DESCRIPTION OF PREFERRED EMBODIMENTS

Figure 1:
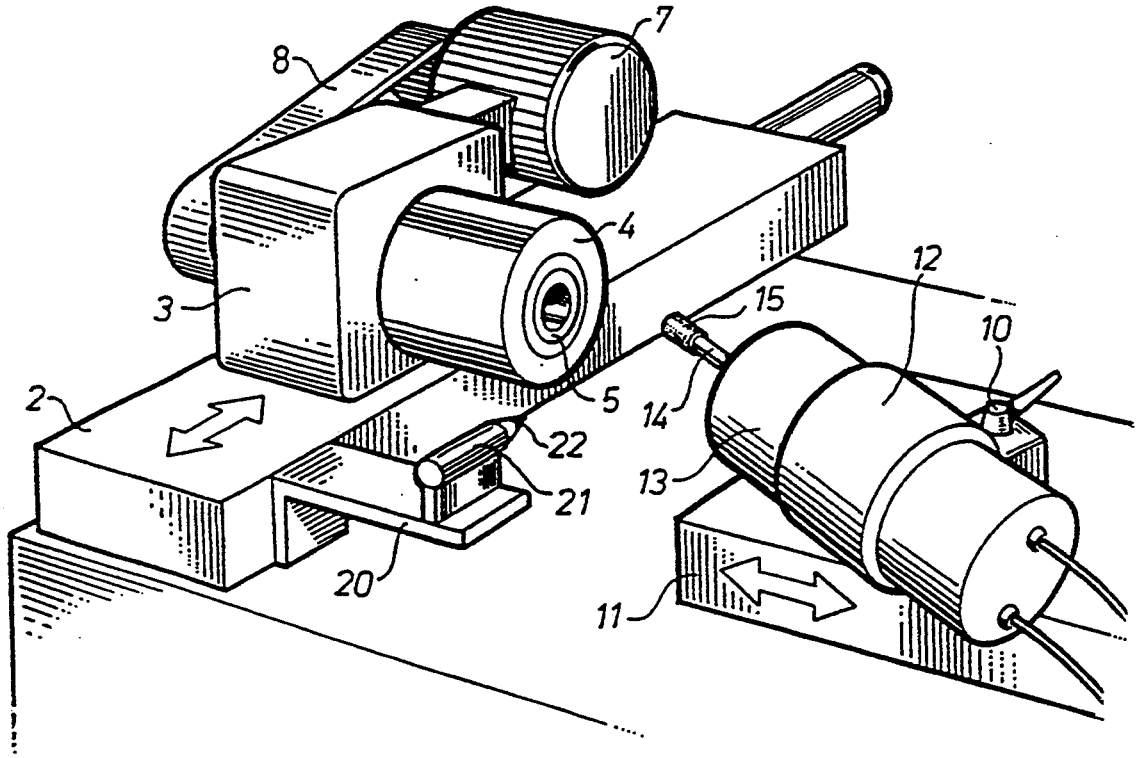
FIG. 1 is a perspective view of essential parts of a grinding machine with which the inventive method can be applied.

In FIG. 1, the reference numerals identify essential components of a grinding machine not shown in detail, namely a feed slide 2, a chuck spindle 3, a chuck 4 mounted for rotation on the spindle 3, a workpiece 5 supported in the chuck, and a bore 6 to be ground. The chuck 4 is driven by a motor 7 via a drive belt 8. The feed slide can move transversely in mutually opposite directions.

Mounted adjacent the feed slide is a table slide 11 which is movable towards and away from the chuck perpendicular to the direction of movement of the feed slide. When grinding long bores, the table slide 11 is moved backwards and forwards so that the grinding wheel, which is shorter than the bore, will grind the bore as straight or as true as possible.

The table slide 11 carries a grinding spindle holder 12 which can be pivoted to different angular positions in relation to the chuck spindle axis and locked therein, with the aid of an adjusting and locking device 10.

The holder 12 supports a grinding spindle 13 which is provided with a grinding spindle extension 14 which carries a grinding wheel 15 on one end thereof. The grinding wheel is shaped, i.e. sharpened, with the aid of means intended herefor, e.g. a diamond tool 22, so as to be slightly conical.

The diamond sharpening tool 22 is carried by a bracket plate 20 supported on the feed slide 2, such that said tool will lie on the same level as the centre line of the rotational shaft of the chuck spindle 3.

Figure 2:
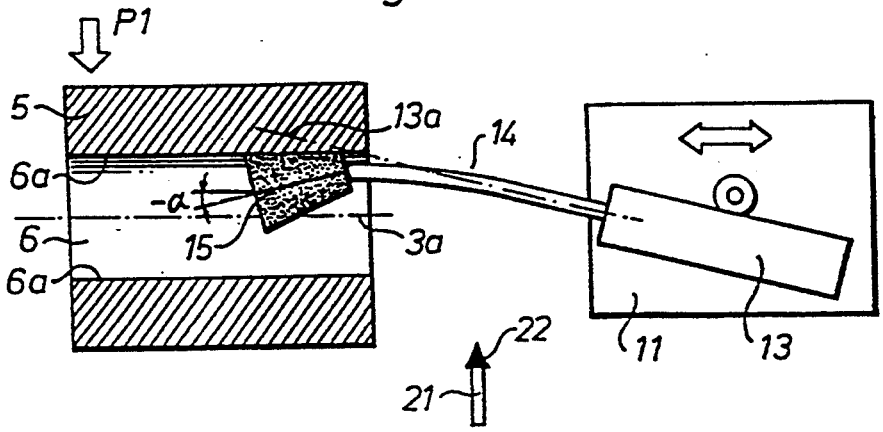
FIG. 2 is a partially sectioned top view which illustrates engagement of the grinding wheel with the workpiece during a rough grinding phase.

FIG. 2 illustrates engagement of the grinding wheel 15 with the bore 6 in the workpiece 5 during the rough grinding phase. The geometric axis 13a of the spindle 13 forms an angle $\alpha$ with the geometric axis 3*a* of the chuck spindle 3. For the sake of clarity, this angle is greatly exagerated in FIGS. 2 and 3, and in practice will be scarcely noticeable.

Figure 3:
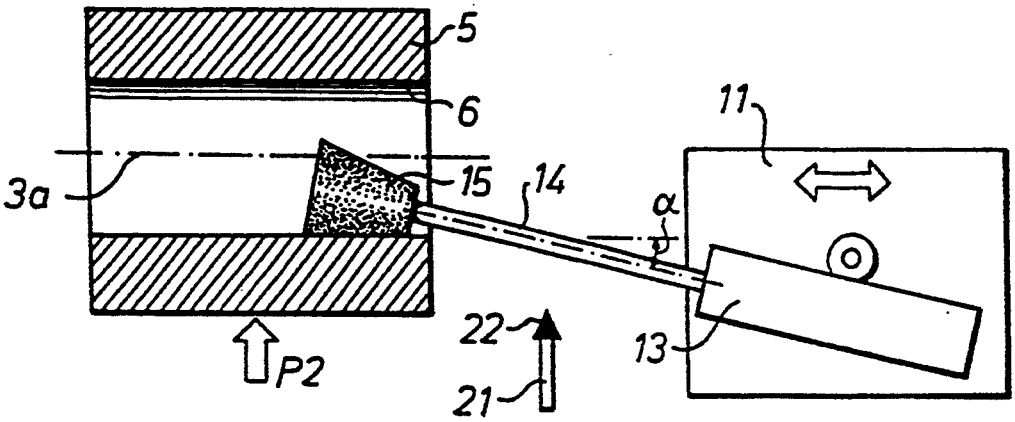
FIG. 3 is a partially sectioned top view, corresponding to FIG. 2, showing engagement of the grinding wheel with the opposite side of the bore during the fine grinding or finishing phase.

The feed direction of the workpiece is indicated by arrows P1 and P2 in FIGS. 2 and 3. The feed pressure resulting from grinding engagement of the grinding wheel 15 with the periphery 6*a* of the bore in the workpiece 5 as the grinding wheel is advanced results in linear and angular deflection of the grinding wheel in relation to the grinding spindle, as illustrated in FIG. 2.

The rough grinding phase is carried out at a feed pressure such that the given angle $2\alpha$ will be essentially levelled-out or eliminated, i.e. the generatrice of the grinding wheel 15 and the generatrice of the bore 6 will substantially coincide, as shown in FIG. 2.

Before coming into engagement with the workpiece in the rough grinding phase, the grinding wheel 15 will have been sharpened by means of the diamond tool 22 along a generatrice which lies opposite to the generatrice of the grinding wheel that is in rough grinding engagement with the bore 6.

The whole of the axial length of the grinding wheel 15 will be active in the rough grinding phase and when grinding the workpiece the table slide 11 is moved backwards and forwards towards and away from the workpiece, so as to enable the full axial length of the bore 6 to be ground along the whole of its axial length.

FIG. 3 illustrates the subsequent fine grinding or finishing operation, which is carried out with substantially coinciding bore and grinding-wheel generatrices along a bore generatrice which is essentially opposite the rough grinding engagement location.

The feed pressure is very slight when effecting the fine grinding phase in accordance with FIG. 3, and consequently the spindle extension 14 will not have been deflected or bent outwards to any great extent, and the angle e preset in relation to the chuck spindle axis 3*a* will prevail along the whole of the length of said spindle extension.

Thus, full abutment between the generatrices of the grinding wheel 15 and the bore 6 will be obtained along substantially the full axial length of the grinding wheel 15 during the fine grinding phase of the grinding cycle.

The arrow P2 in FIG. 3 indicates the feed direction of the workpiece during the fine grinding phase.

As before mentioned, the grinding wheel can be set to numerically smaller positive or negative angles. This can be effected, for instance, when sharpening the grinding wheel, by pivoting or swinging the grinding spindle through a given small angle and returning the spindle 13 to its starting position when sharpening of the wheel is completed.

The angle $\alpha$ can also be re-set, for instance during the rough grinding phase, by means of the setting and locking device 10, without necessarily using the aforementioned general computer-controlled arrangement for effecting pivotal movement during the grinding process. Such adjustments to the angle can be made, for instance, to generate a greater feed force during part of the rough grinding phase, for instance. The feed force may also be reduced, by simply pivoting the grinding wheel in the opposite direction.

Figure 4:
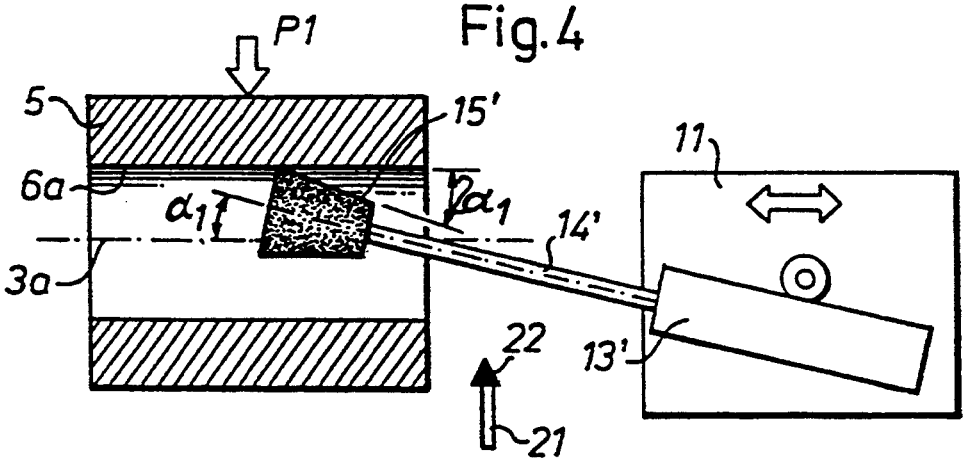
FIGS. 4 and 5 are schematic illustrations of a rough grinding and fine grinding operation respectively while using two different spindles and associated grinding wheels, the respective spindle axle extensions being adjusted to different angles during the rough and fine grinding phases respectively.
Figure 5:
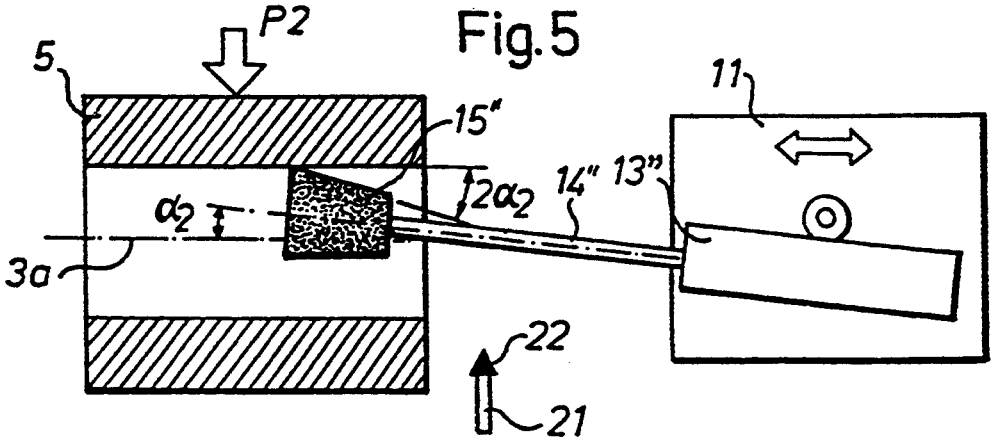

FIGS. 4 and 5 illustrate an embodiment in which two mutually different grinding wheels 15′ and 15″ are used in the rough grinding and fine grinding phases. The spindle setting and sharpening of the wheel correspond to the aforedescribed with reference to the rough grinding method illustrated in FIG. 2. FIG. 4, however, shows the grinding wheel in the position taken by the wheel upon completion of a sharpening operation, in which position the generatrice of the sharpened wheel is parallel with the chuck spindle axis 3*a*, this generatrice being opposite to the generatrice along which the rough grinding engagement takes place in a subsequent grinding moment.

In FIG. 4 the grinding spindle 13′ and its extension 14′ form an angle $\alpha_1$ with the chuck spindle axis 3*a*.

Subsequent to applying feed pressure, by moving the chuck spindle in the direction of the arrow P1, the grinding spindle extension 14 will be deflected or bent in the same manner as that shown in FIG. 2, such that the rough grinding engagement takes place along a generatrice which is opposite to the generatrice along which the grinding wheel 14 was sharpened by the diamond tool 22.

FIG. 5 illustrates a subsequent fine grinding operation with the aid of another grinding wheel 15'', which is carried by a grinding spindle extension 14'' and driven by a grinding spindle 13''.

This spindle 13'' has been set to an angle $\alpha_2$ relative to the chuck spindle axis 3a.

The angle $\alpha_2$ is smaller than the angle $\alpha_1$ which ensures parallelity with the chuck spindle 3a even during the fine grinding phase, which is effected at very small feed pressure.

Figure 6:
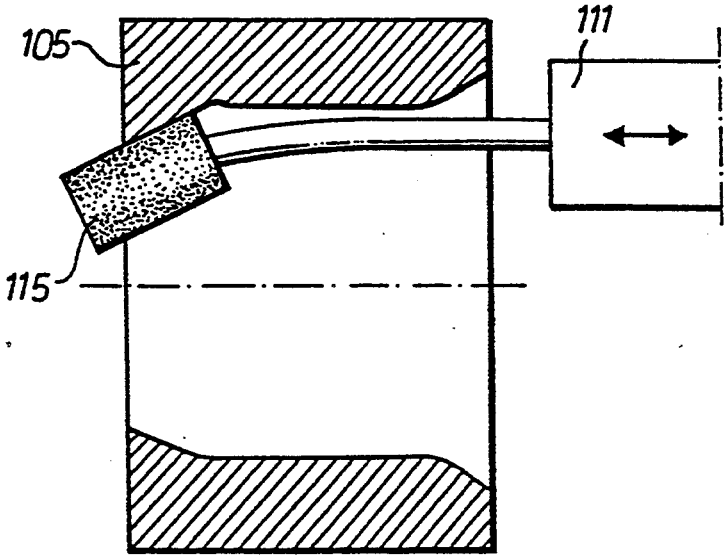
Fig. 6 PRIOR ART
FIG. 6 illustrates, finally, the formation of an undesired bore configuration obtained when employing bore grinding methods normally applied.

In contrast to the grinding procedure effected in accordance with the invention in the manner illustrated in FIGS. 1–5, FIG. 6 illustrates a known, often used bore grinding method with which bores of undesirable shapes are generated. The grinding process effected according to the known state of the art involves a relatively long reciprocating movement between grinding wheel and workpiece, which results in an untrue or crooked bore due to erroneous pivoting of the grinding wheel. As illustrated in FIG. 6, this is particularly manifest at the ends of the bore, where only a part of the length of the grinding wheel is located within the bore. In FIG. 6, which thus represents an earlier known grinding method, the workpiece is referenced 105, the grinding wheel is referenced 115 and the reciprocatingly movable table slide is referenced 111.

In the case of the inventive embodiments illustrated in FIGS. 1–5, both the rough grinding phase and the fine grinding phase of a grinding cycle are carried out with substantially full abutment between the generatrice of the grinding wheel and the generatrice of the bore at the grinding engagement location, therewith ensuring the greatest possible effectiveness of a grinding operation. The ground bore will also be extremely straight.

The grinding operation can be carried out with the aid of simple means, i.e. without needing to program a control computer with complicated software. Instead, all that is needed is adjustment of the presetting of the grinding spindle to the desired feed pressure.

The movement path travelled by the grinding wheel between the rough grinding and fine grinding locations is minimum.

It will be understood that the angular positions to which the aforesaid settings are made can be modified in a manner to render the grinding process effective, without departing from the basic concept of the invention. Furthermore, the rough grinding and fine grinding phases can be carried out with one and the same grinding spindle or with different grinding spindles without unduly complicating or influencing the grinding operation as a whole.

I claim:

1. A method for a computer-controlled internal grinding of a workpiece bore with a conical grinding wheel carried on a free end of a flexible grinding spindle extension (14) with substantially full abutment between respective generatrices of the grinding wheel and the bore, both during a rough grinding phase and a fine grinding phase of a bore grinding operation, comprising the steps of:

a) positioning a rotational axis of the conical grinding wheel at a small angle ($\alpha$) relative to a rotational axis of the bore, said conical grinding wheel having a conicity tapering inwardly at said small angle from the free end of the spindle extension;

b) sharpening the grinding wheel along a generatrix disposed diametrically opposite a generatrix along which the grinding wheel engages the bore; and c) carrying out the rough grinding phase at a workpiece feed pressure which bends the flexible spindle extension to about twice said small angle ($2\alpha$) such that the generatrix of the grinding wheel coincides substantially with the generatrix of the bore.

2. A method according to claim 1, wherein the fine grinding phase is carried out with the same grinding wheel as the rough grinding phase and with substantially coinciding bore and grinding-wheel generatrices along a bore generatrix which is substantially diametrically opposite relative to a location of rough grinding engagement.

3. A method according to claim 1, wherein the positioning angle of the rotational axis of the grinding wheel is varied during the grinding process to attendantly vary the feed pressure during the rough grinding and fine grinding phases.

4. A method according to claim 1, wherein the fine grinding phase is carried out with a separate grinding wheel made of softer material than a rough grinding wheel, and the rough and fine grinding wheels are tapered at different angles in relation to the rotational axis of the workpiece bore.

5. A method according to claim 4, wherein the fine grinding wheel is tapered at a smaller angle than the rough grinding wheel.

6. A method according to claim 1, wherein the spindle axis of the grinding wheel is pivoted through a given small angle when sharpening said wheel, and pivoted back to a starting position when sharpening is completed.

7. A grinding machine for internally grinding a workpiece bore with full abutment between a generatrix of a grinding wheel and a generatrix of the bore, both in rough grinding and fine grinding phases, said grinding machine including:

a) a chuck spindle (3) mounted on a feed slide (2) and supporting a workpiece (5) having a bore (6) formed therein;

b) a table slide (11) mounting a grinding spindle (13) provided with a flexible grinding spindle extension (14), and a conical grinding wheel (15) mounted on a free end of said extension;

c) means (10) for positionally adjusting and fixing the grinding spindle such that a rotational axis thereof defines a predetermined angle ($\alpha$) in relation to a rotational axis (3a) of the workpiece bore;

d) means for regulating a feed pressure of the workpiece during the grinding operation;

e) a grinding wheel sharpening tool (22); and f) a computer for controlling the grinding process, wherein:

g) the conical grinding wheel (15) tapers conically inwardly from the free end of the grinding spindle extension (14) at said predetermined angle;

h) the sharpening tool (22) is adapted to engage the grinding wheel along a generatrix which is substantially diametrically opposite a grinding wheel generatrix when said wheel is in rough grinding engagement with the bore (6); and i) rough grinding engagement takes place at a feed pressure which bends the flexible spindle extension to about twice the predetermined angle ($2\alpha$) generatrix and the grinding wheel generatrix substantially coincide.

8. A grinding machine according to claim 7, in which the same grinding wheel (15) is used to effect both the rough and the fine grinding phases, and wherein a fine grinding engagement between the grinding wheel and the bore (6) is located along a bore generatrix which is essentially opposite the generatrix at a rough grinding location.

9. A grinding machine according to claim 7, in which different grinding wheels (15', 15") are used for the rough grinding phase and the fine grinding phase, respectively, wherein the rough grinding wheel and the fine grinding wheel taper at different angles ($\alpha_1$ and $\alpha_2$), and the taper angle ($\alpha_2$) of the fine grinding wheel is smaller than the taper angle of the rough grinding wheel ($\alpha_1$).

10. A grinding machine according to claim 7, wherein the sharpening tool (22), is mounted on a bracket (20) which projects out from the feed slide, and engages the grinding wheel (15) substantially on a level with the rotational axis (3*a*) of the chuck spindle.

* * * * *